United States Patent [19]

Bowlsby

[11] 4,420,852

[45] Dec. 20, 1983

[54] DRAIN CLEANING MACHINES

[76] Inventor: David Bowlsby, 533 W. State St., Ithaca, N.Y. 14850

[21] Appl. No.: 262,202

[22] Filed: May 8, 1981

[51] Int. Cl.[3] ..... B08B 9/02

[52] U.S. Cl. ..... 15/104.3 SN; 134/166 C

[58] Field of Search ..... 15/104.3 SN, 104.3 R; 134/167 C, 168 C, 166 C, 169 C, 167 R; 239/DIG. 13, 600, 184, 587; 137/580; 138/44, 109; 175/173, 107; 242/86, 86.1, 86.3; 285/45, 173, 329, 422, DIG. 24, 190; 403/164, 165, 311, 320; 411/222, 223, 231

[56] References Cited

U.S. PATENT DOCUMENTS

| | | | |
|---|---|---|---|
| Re. 30,175 | 12/1979 | Mier | 15/104.3 SN |
| 2,940,099 | 6/1960 | Kollmann | 15/104.3 SN |
| 3,075,535 | 1/1963 | Lasting | 134/167 C |
| 3,370,599 | 2/1968 | Ciaccio | 15/104.3 SN |
| 3,959,840 | 1/1976 | Sato | 15/104.3 SN |
| 4,031,971 | 6/1977 | Miller | 175/107 |

*Primary Examiner*—Harvey C. Hornsby
*Assistant Examiner*—Michael Knick
*Attorney, Agent, or Firm*—Michael F. Brown; Ralph R. Barnard

[57] ABSTRACT

An improvement in drain cleaning machines comprising a removable drum containing a length of coiled spring snake in which is inserted a flexible tube for carrying a flow of water to the free end of the snake. The hub of the drum is designed to mount upon a powered shaft adapted to injecting water at house pressure into the center of the hub, and thus into the tube, without leakage. In one embodiment, a swivel is formed inside the free end of the snake, to allow differential twisting between the tube and the snake, thus avoiding kinking of the tube.

2 Claims, 4 Drawing Figures

DRAIN CLEANING MACHINES

TECHNICAL FIELD

The invention pertains to apparatus for cleaning pipes and the like. More specifically, the invention relates to improvements in the type of draincleaning machine which utilizes a powered coil spring "snake" to clean accumulated sediment and other material from sewer drains.

BACKGROUND ART

Machines using a coiled spring "snake" to clean drains have long been known. Most machines in use today utilize a power source to rotate the coil,making the action of the snake inserted into the drain more effective. The best known of such machines, and the device upon which the preferred embodiment of the present invention is based, is the familiar Roto-Rooter TM machine.

In certain conditions of sludge or ice blockage, however, the snake used alone may be of limited effectiveness. The snake may penetrate the soft sludge easily, but the blockage re-forms behind the snake as it is withdrawn. What is needed under such conditions is a sufficient flow of water at the head, or free, end of the snake to wash the sludge down the sewer as the snake is pulled back toward the operator.

Several prior inventions have attempted to combine a snake with a water injection system (see Sato, U.S. Pat. No. 3,959,840; or Ciaccio, U.S. Pat. No. 3,370,599) through insertion of a tube into the inside of the coiled spring snake. These inventions represented the use of a blast of high-pressure water (as much as 10,000 p.s.i. in the Ciaccio machine) to punch through blockages.

These very high pressures require extremely heavy and rugged (hence expensive) components. The tubes must have thick walls to withstand the pressure used. On the other hand, "head" losses caused by friction between the water and the walls of the tube are aggravated under high pressure conditions, so large inside diameters are needed to achieve sufficient pressure at the working end of the snake. Thus the tubing needed becomes large and of limited flexibility. The Ciaccio machine uses tubing so large in outside diameter that a snake of over an inch in diameter is required to contain it. This is far too large for home drains, and its limited flexibility would make it difficult or impossible for the snake to traverse the bends commonly found in house plumbing. Were the tubing made much thinner, it would not be able to hold up under the tremendous pressures used.

Any machine which needs such high pressure also requires some additional machinery to generate the pressures, limiting the portability of the device. This is a major factor in home work, where the sewer drain is usually located in a cellar or other cramped quarters. The extra machinery adds both weight and bulk. Ciaccio is mounted on a vehicular trailer, and Sato has an external pump and reservoir set-up.

The machines noted are built with fixed drums, at least in part because of the difficulty of preventing leakage at the pressures used. Thus, the user must transport the heavier and thicker spring and tube combination, even when the water is not needed. If an especially thin coil is needed, another machine will have to be brought in.

SUMMARY OF THE INVENTION

Thus, it can be seen that the use of high pressures poses great problems. This invention is based on my discovery that, in fact, high pressures are not necessary for handling the kinds of sludge and ice problems previously described, which are most commonly found in the cleaning of home sewer drains. What is needed is not to blast the blockage away with *pressure,* but rather to wash it away with water *flow* from the rear, having penetrated the blockage with the snake. Once this is realized, the process of drain cleaning becomes feasible using house pressure water (on the order of 100 p.s.i. or less), rather than the thousands of pounds of pressure used by previous machines. For clearance of blockages caused by ice, especially, hot or warm water at house pressure may be used effectively by the invention. Because of the relatively low pressure, an adequate flow can be maintained through the use of thin walled tubing, with the added benefit of increased flexibility.

I have determined that the minimum inside diameter of the tube should be approximately 5/16". Because of the effects of frictional losses, it is difficult to maintain adequate flow at house pressure in snakes of 100 feet or more in tubing of smaller diameter. For a shorter snake, it will be realized that smaller tubing may be used within the scope of the invention, so long as an adequate flow can be established in the tube.

My invention represents the provision of a replaceable cable-carrying drum for Roto-Rooter TM machines, or the like, with a flexible tube of 5/16" or greater inside diameter inserted inside the coiled spring snake, which must obviously be of adequate inside diameter to accommodate the outside diameter of the tubing used. The tube connects to the hollow hub of the drum, which supports the drum upon the powered shaft of the machine. The drum hub is adapted to mate, without leakage of water, with the drum-supporting powered shaft, which is drilled or made of hollow material to carry the water into the drum, hub from a fitting on the outside of the machine.

A principal object of the invention is to provide a means of introducing a stream of water into a sewer drain to be cleaned, by means of water flow through a drain cleaning snake, using only house-pressure water.

A further object is to provide an improvement in Roto-Rooter TM tyoe machines, or the like, in the form of a modification to permit the use of water at house pressure through provision of a special removable drum, and modification of the machine to accept such a drum.

A still further object of the invention is to provide a removable drum for such machines, as modified, which may be easily replaced by other drums when the water flow is not needed.

Still another object of the invention is to provide a light, portable drain cleaning machine which will work effectively in ridding drains of sludge and ice.

Other objects and advantages will become obvious as the detailed description of the invention proceeds.

DESCRIPTION OF THE PREFERRED EMBODIMENT

Figure 1:
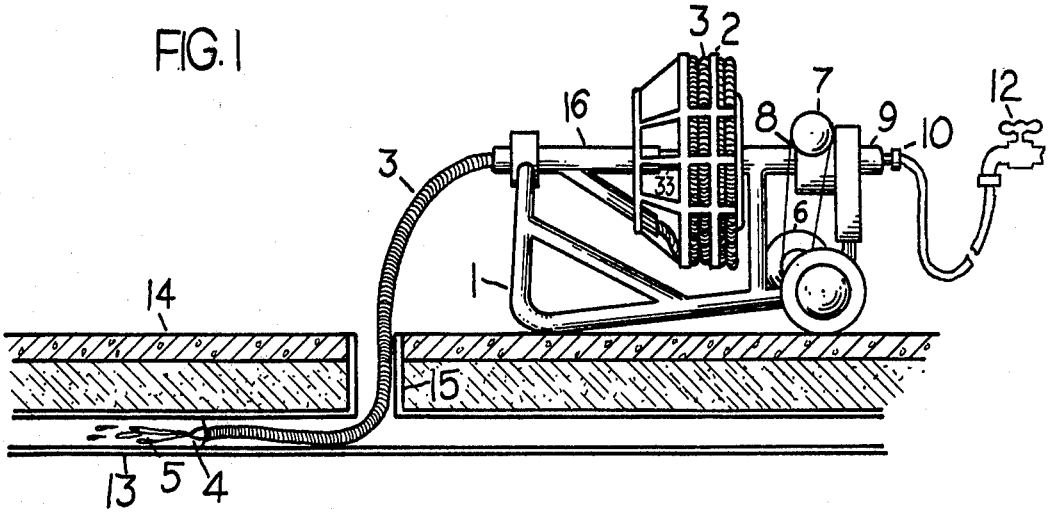
FIG. 1 shows an over-all view of the invention in use

The preferred embodiment of the invention is an improvement on the well-known Roto-Rooter TM type machine, illustrated in use in FIG. 1. The basic machine comprises a frame (1) upon which is mounted a removable drum (2). The drum (2) contains a coiled spring snake (3). One side of the drum is mounted upon a shaft (9) which is rotated by a motor (6) through a pulley (7) and gearbox (8) arrangement. The opposite end of the drum is supported by a retractable shaft (33) which retracts into a supporting shaft (16) to allow removal of the drum.

In the machine, modified according to the teachings of the invention, water is fed into a gallery in the center of the shaft (9) from a supply of water at house pressure (12) through a swivel coupling in the end of the shaft (10). The water is fed from the shaft through the drum hub to a tube inserted into the snake (3), as will be seen below in the discussion of FIG. 2, and exits at the free end of the snake (4) in a spray (5), washing accumulated sludge or ice down the sewer drain to be cleaned (13).

Figure 2:
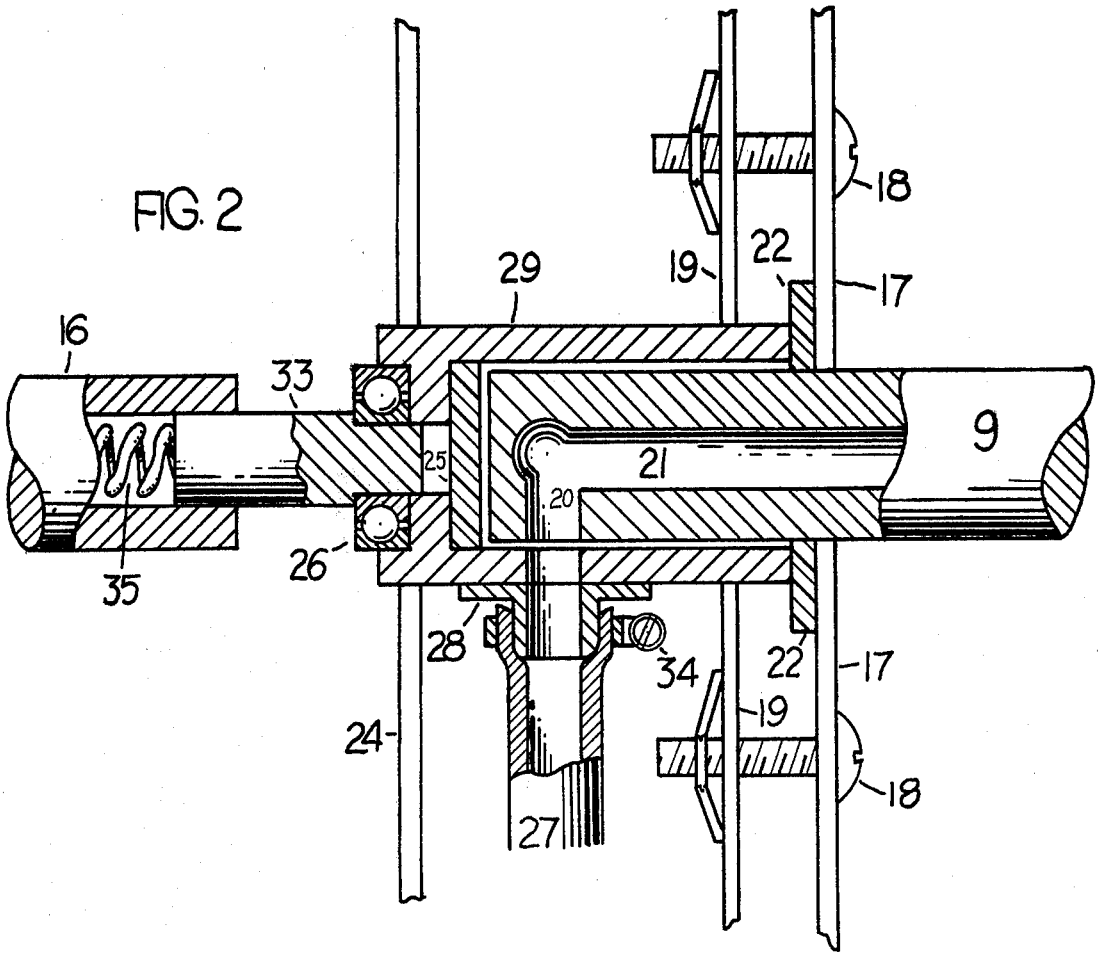
FIG. 2 shows a cut-away view of the drum hub and powered shaft

FIG. 2 shows a detail view of the hub (29) of the drum (2), mounted upon the powered shaft (9), cut away to show the internal details.

A gallery (21) is drilled into the center of the solid shaft (9) from the hose fitting on the outside end. (See FIG. 1) A side gallery (20) is provided near the opposite end of the shaft to allow the water to flow into the hub. Alternatively, the main gallery could be drilled through the end of the shaft, or a hollow pipe used for the shaft, eliminating the side gallery.

The shaft has a flange (17) mounted upon it, the flange projecting from the shaft perpendicularly to its long axis. The flange fastens via clamps (shown as toggle bolts (18), although any clamping means could be used) which clamps onto the rear drum struts (19) which are attached to the drum hub, and support the outside of the drum. Similarly, front drum struts (24), attach to the hub and support the outside of the drum. This clamping action presses the seals (22) firmly between the flange and the hub, preventing leakage of water at the shaft-drum junction.

The hub is supported at the opposite end by the retactable shaft (33), which fits into a bearing (26) on the end of the hub. Although shown as a ball-bearing, it will be recognized that any form of bearing may be used. The bearing hole is here shown sealed by a solid seal (25), but a sealed bearing might have been used instead, or the bearing hole might simply not have been drilled completely through, as desired, so long as the drum hub remains watertight.

The retractable shaft (33) is pressed against the hub (29) and into the bearing (26) by a spring (35) inside the supporting shaft (16). The retractable shaft is pushed back against the spring into the supporting shaft to remove the drum from the machine.

The tube (27), inserted into the center of the snake (3), is attached and secured, for example by a hose clamp (34) as shown, to a nipple, or other similar fitting (28), attached to the outside of the hub, and communicating with the interior thereof, such that the water in the hub is fed into the tube.

Figure 3:
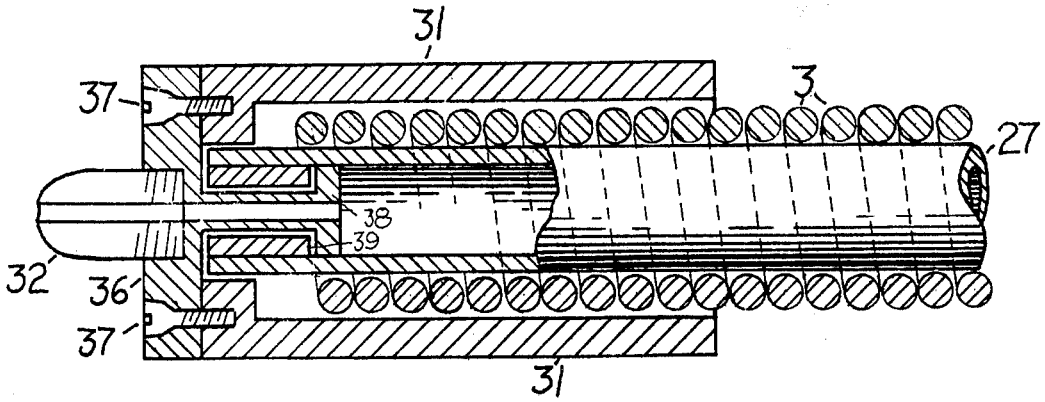
FIG. 3 shows a partially cut-away detail of the preferred embodiment of the end of the snake.
Figure 4:
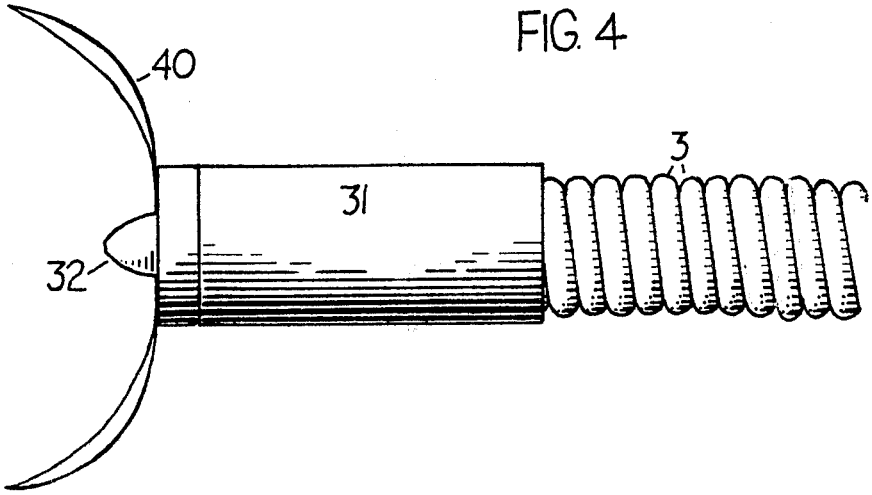
FIG. 4 shows a view of the end of the snake, with an optional cutting blade attached.

FIG. 3 shows a partially cut-away view of the end of the snake ((4) in FIG. 1), as used in the preferred embodiment of the invention. The coiled spring snake (3) has an end (31) affixed thereto, for example by welding or bonding, upon which is mounted a nozzle (32) to direct the water along the axis of the snake. It will be recognized that the design of the end of the snake (31) is not critical to the invention, but may in fact be any convenient design (for example with cutting blades or other implements) to meet conditions, so long as a means for directing the water flow down the long axis of the snake is provided. FIG. 4 shows such an arrangement, with a blade (40) attached to the end (31) by securing the blade between the nozzle (32) and the end plate (36).

The tube (27) leading from the drum hub may be directly connected to the said nozzle, which may be of any convenient design, without departing from the teachings of the invention. I have found, however, that the snake will tend to twist independently of the tube under normal use, especially if it encounters any obstruction in the pipe. This results in "kinking" of the tube, with a possibility of tube breakage, or, at the very least, in a restriction in water flow. Thus, in the preferred embodiment of the invention the tube attaches to a swivel coupling (as detailed below) which then attaches to the end of the snake (31). This permits differential twisting between the tube and the snake, with a lessened chance of "kinking" or breakage.

The swivel coupling is made up of a sleeve (39) which is attached, for example by gluing, to the inside wall of the tube (27). The sleeve must fit exactly inside the tube, without expanding the outside diameter of the tube, so that the tube does not bind on the end of the snake (31) which surrounds it. The sleeve (39) slips around an extension of the cable end plate (36) and is held in place by a flange (38). The end plate (36) is held rigidly to the cable end (31) by screws (37), and the nozzle (32) is threaded, or otherwise suitable mounted, upon it. The sleeve and end plate form a swivel coupling, allowing the snake end (31), end plate (36), and flange (38) to rotate together, independent of the tube (27) and sleeve (39).

It should be understood that the principles of the invention, although illustrated as a modification to a Roto-Rooter TM machine, are equally applicable to any similar machine, of whatever make.

Accordingly, it is to be understood that the embodiments of the invention described herein are merely illustrative of the application of the principles of the invention. Reference herein to the details of the illustrated embodiment are not intended to limit the scope of the claims, which themselves recite those features regarded as essential to the invention.

I claim:

1. In a drain cleaning machine of the type having a removable powered rotatable drum for storing a length of coiled spring snake for insertion into the drain to be cleaned; said drum mounted upon, and cooperating with, a powered rotatable shaft having two portions, one adapted to supporting and engaging the drum, the other adapted to receiving the rotary power; power means for imparting rotating power to the shaft; said coiled spring snake being attached at one end to the drum such that a rotary motion is imparted to the other, free, end of the snake, which is inserted into the drain to be cleaned; means for supporting the shaft and the drum in cooperation with each other; wherein the improvement comprises providing a stream of water to the free end of the snake by means of a modification to the machine comprising:

(a) said powered rotatable shaft having a gallery extending from the end of the shaft adapted to receiving the rotary power to a point in the outside of the shaft in the drum supporting portion;

(b) swivel coupling means for attaching a water-supply hose from a source of house pressure water to the rotatable shaft such that water from said source of house pressure water passes from said hose into the gallery through the power receiving end;

(c) flange means for engaging the drum mounted upon the drum-supporting portion of the rotatable shaft;

(d) hub means for supporting the frame of the drum upon the drum-supporting portion of the rotatable shaft, having means for attaching a hose on the outside surface of the hub, said means for attaching a hose communicating with the interior of the hub means, for feeding water from the interior of the hub means into a tube attached to the hose attaching means;

(e) seal means for preventing leakage between the hub means and the flange means;

(f) clamp means for holding the hub means firmly against the flange means of the rotatable shaft, such that they compress around the seal means without leakage of water;

(g) flexible tube means for carrying water, inserted inside the coiled spring snake, having an inside diameter of at least 5/16" and a length at least equal to the length of the coiled spring snake;

(h) cable end means rigidly attached to the free end of the coiled spring snake;

(i) nozzle means for directing water flow, mounted upon the cable end means, and aligned along the longitudinal axis of the cable end, such that water passing through the nozzle means is directed down the pipe to be cleaned;

(j) said tube means being connected at one end to the hose attaching means of the hub means, and at the other end to the nozzle means mounted upon the cable end means of the coiled spring snake;

(k) the cable end means at the free end of the coiled spring snake attaching to the tube means through a swivel coupling means for allowing differential twisting between the snake and the tube.

2. The drain cleaning machine of claim 1 in which the swivel coupling means comprises:

(a) sleeve means for engaging the tube means, attached to the inside wall of the flexible tube means at the free end of the flexible tube means;

(b) end plate means rigidly attached to the cable end means, having an extension fitting slidably inside the sleeve means;

(c) flange means for preventing the sleeve means from moving longitudinally along the extension of the end plate means;

(d) gallery means for passing water through the extension of the end plate means into the nozzle means;

(e) said sleeve means being of such size as to fit inside the tube means without causing the tube means to expand its outside diameter.

* * * * *